United States Patent [19]

Huskins

[11] 3,995,445

[45] Dec. 7, 1976

[54] COOLING RECEPTACLE FOR INDIVIDUAL BEVERAGE CONTAINERS

[75] Inventor: George Huskins, Miami, Fla.

[73] Assignee: Lawrence Peska Associates, Inc., New York, N.Y. ; a part interest

[22] Filed: Jan. 14, 1976

[21] Appl. No.: 648,962

[52] U.S. Cl. ..... 62/371; 62/457; 62/530

[51] Int. Cl.[2] ..... F25D 3/08

[58] Field of Search ..... 62/457, 529, 530, 371, 62/372

[56] References Cited

UNITED STATES PATENTS

| | | | |
|---|---|---|---|
| 1,369,367 | 2/1921 | Thomson | 62/457 |
| 1,999,670 | 4/1935 | Strouse et al. | 62/372 |
| 2,039,736 | 5/1936 | Muntens et al. | 62/457 |
| 2,767,563 | 10/1956 | Picascia | 62/372 |
| 3,302,427 | 2/1967 | Stoner et al. | 62/457 |
| 3,302,428 | 2/1967 | Stoner et al. | 62/457 |
| 3,373,579 | 3/1968 | Federighi | 62/457 |
| 3,387,650 | 6/1968 | Hoffman et al. | 62/371 |
| 3,603,106 | 9/1971 | Ryan et al. | 62/457 |

FOREIGN PATENTS OR APPLICATIONS

| | | | |
|---|---|---|---|
| 182,960 | 7/1922 | United Kingdom | 62/371 |

*Primary Examiner*—Lloyd L. King
*Attorney, Agent, or Firm*—Joel Halpern

[57] ABSTRACT

A cooling receptacle for individual beverage containers comprises a double-walled cylinder open at the top and closed at its base. The base is hollow and contains a high density granular material. The inner cylindrical wall is formed of a material having a higher thermal conductivity than the material of the outer cylindrical wall. An annular resilient retaining element is secured to the inner surface of the inner cylindrical wall. A detachable closure disc formed of a material having a relatively low thermal conductivity and having a central opening exposing the cavity of the receptacle is adapted to seal the cooling chamber between the inner and outer cylindrical walls of the receptacle.

7 Claims, 4 Drawing Figures

COOLING RECEPTACLE FOR INDIVIDUAL BEVERAGE CONTAINERS

BACKGROUND OF THE INVENTION

The present invention relates to cooling receptacles and more particularly to portable cooling receptacles of the type adapted to accommodate a single beverage container.

Cooling receptacles designed to receive an individual beverage container have been known heretofore. However, such containers were so constructed as to receive the beverage containers therewithin such that at least one of the side walls of the beverage container was in contact with an internal side wall of the cooling receptacle so as to facilitate the conduction of heat through the receptacle side wall. Further, it was also conventional to construct the internal bottom end wall of the receptacle of a relatively high thermal conductivity material so as to provide for the conduction of heat through such wall.

As is known, some degree of condensation occurs within cooling receptacles of this type, and one of the disadvantages of such receptacles resides in the freezing of such condensate films at the interface or points of contact between the receptacle and the beverage container. This phenomenon makes it difficult to remove the beverage container, and when such container is made of a thin glass there is the risk of breakage.

It is also a disadvantage of prior individualized beverage container receptacles that where there is a loose fit between the beverage container and the internal walls of the receptacle, there is the risk of dislodgement of the container in the receptacle either through inadvertant accidental shifting of the receptacle or during carrying of the receptacle from one location to another. Such dislodgement tends to aggravate the problem of freezing discussed above, particularly when non-alcoholic beverages are being cooled.

In addition, the weight of the beverage and its container frequently constitute the major portion of the weight of the receptacle plus container. Since the center of gravity of the container, when disposed within the receptacle, is not coincident with the center of gravity of the receptacle, a mechanical couple is created which contributes to the instability of the composite structure.

SUMMARY OF THE INVENTION

It is one object of the invention to provide a cooling receptacle for individual beverage containers which accommodates the beverage container therein in a manner which avoids adherence of the container to the internal surfaces of the receptacle by freezing.

It is another object of the invention to provide a cooling receptacle for individual beverage containers which permits transport of the receptacle and container with minimal risk of accidental release of the container.

It is another object of the invention to provide a cooling receptacle for individual beverage containers which is stabilized against inadvertant dislodgement.

According to the present invention there is provided a cooling receptacle for individual beverage containers comprising:

a hollow double-walled vessel including an inner side wall formed from a material having a relatively high thermal conductivity and defining the container-receiving cavity therein, an outer side wall formed from a material having a relatively low thermal conductivity, said inner and outer side walls providing an annular cooling chamber therebetween, and a hollow base defined by top, bottom and side walls of a material having a relatively low thermal conductivity containing a sufficient quantity of a relatively high density granular material to weight said receptacle and stabilize same against inadvertant toppling;

a beverage container retaining ring secured to the inner surface of said inner side wall above said base and formed from a resilient material having a thermal conductivity lower than the material of said inner side wall;

and a detachable closure ring adapted to close the upper end of said annular chamber.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
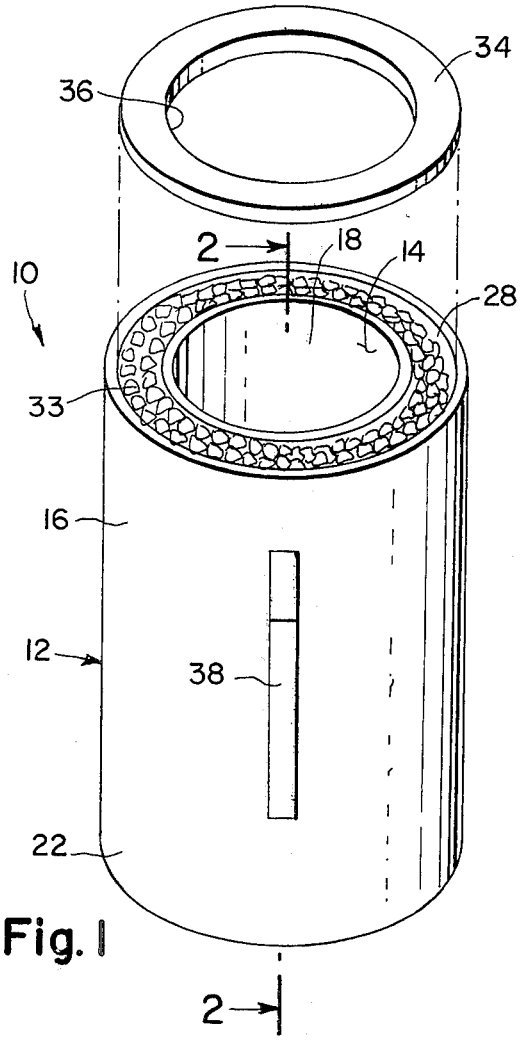
FIG. 1 is a perspective view of a cooling receptacle in accordance with the invention.

Referring to the drawings there is shown a cooling receptacle 10 for individual beverage containers. Such containers may take the form of beer or soda cans or a glass container a beverage intended to be consumed while at a cool or cold temperature state.

The cooling receptacle comprises a double-walled vessel 12 and includes an inner cylinder or side wall element 14 and an outer cylinder or side wall element 16. The inner side wall element is made of a material having a relatively high thermal conductivity. The cavity 18 of the receptacle is defined within the inner side wall and is dimensioned to receive an individual can of beer or soda or a standard drinking glass 20 shown by dotted line in FIG. 2. The outer cylinder or side wall of the receptacle is made of a material having a lower thermal conductivity than that of the inner cylinder so as to inhibit the transmission of heat therethrough from outside the receptacle.

The receptacle is provided with a hollow base 22 within which there is positioned a high density granular material 24 such as sand. The purpose of the hollow base and granular material therein is to impart enhanced stability to the receptacle.

A retaining ring 26 is secured to the inner surface of the inner cylinder and is desirably made of a resilient material such as rubber or a suitable synthetic polymeric material. The ring should be made of a material having a lower thermal conductivity than the material from which the inner cylinder 14 is constructed. In this manner the beverage container is maintained in spaced but close relation to the inner side wall of the receptacle. Also, the resilient nature of the ring affords secure retention of the beverage container within the cavity of the receptacle so as to permit transport of the receptacle with the beverage container securely positioned therein.

Figure 2:
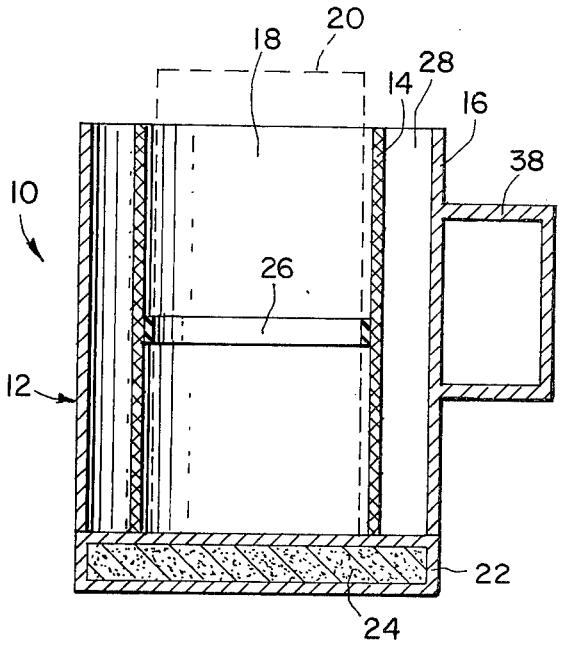
FIG. 2 is a cross-sectional elevational view of the cooling receptacle shown in FIG. 1 taken along line 2—2 thereof.
Figure 3:
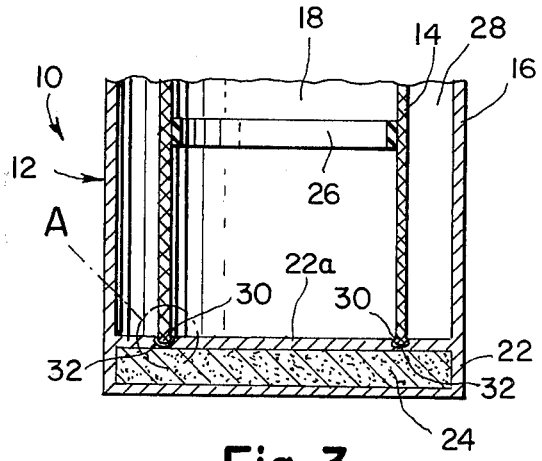
FIG. 3 is a view similar to that of FIG. 2, except that it is broken, showing a second embodiment of the invention.
Figure 4:
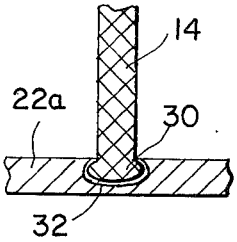
FIG. 4 is an enlargement of inset A from FIG. 3.

The inner and outer cylinders or side walls define a cooling chamber 28 therebetween in the form of an annulus which is open at its upper end. The lower extremities of the inner and outer cylinders terminate either at the base of the receptacle as shown in FIG. 2 or the outer cylinder may be formed integral with the base as shown in FIG. 3. In such event only the inner cylinder will terminate at the lower end thereof at the top wall of the base. The outer cylinder or side wall 16 and the base of the receptacle may be formed of a synthetic polymeric material such as polyethylene or polypropylene.

It may be convenient to so construct the receptacle that the inner cylinder is detachably secured to the base. FIG. 3 illustrates one such construction which may be employed. The cylinder 14 is open at both ends, and adjacent one end there is formed a bead or enlargement 30. A recess 32 is formed in the upper surface of the top wall 22*a* of the receptacle base, the bead and recess being dimensioned and cooperable to facilitate the snapping in place of the cylinder 14 during assembly of the receptacle.

As shown in FIG. 1 a cooling medium 33 such as ice is inserted into the cooling chamber and, being in contact with inner cylinder 14, establishes a temperature gradient across the wall thereof so as to effect a heat transfer flow through the wall from the cavity.

A handle 38 is provided on the external surface of the receptacle to facilitate transport of the receptacle from one location to another.

A detachable closure ring 34 is dimensioned to seal the cooling chamber at its upper end. The ring has a central opening 36 of substantially the same diameter as that of the internal diameter of the inner cylinder so as not to interfere with the insertion and removal of the beverage container in relation to the receptacle. Desirably the closure ring is formed of a material having a low thermal conductivity. Various synthetic plastic materials may be employed. One such material is styrafoam.

From the foregoing it will be seen that a cooling receptacle for individual beverage containers has been provided which, while affording a low-temperature environment therein, provides for insulated mounting of the beverage container such that neither the end or walls of the container come into contact with the chilled internal walls of the receptacle. Further, the construction of the container is such that enhanced stability is imparted to the receptacle through the provision of the weighted base, such base not being chilled.

I claim:

1. A cooling receptacle for individual beverage containers comprising:

a hollow double-walled vessel including an inner side wall formed from a material having a relatively high thermal conductivity and defining the container-receiving cavity therein, an outer side wall formed from a material having a relatively low thermal conductivity, said inner and outer side walls providing an annular cooling chamber therebetween, and a hollow base defined by top, bottom and side walls of a material having a relatively low thermal conductivity containing a sufficient quantity of a relatively high density granular material to weight said receptacle and stabilize same against inadvertant toppling;

a beverage container retaining ring secured to the inner surface of said inner side wall above said base and formed from a resilient material having a thermal conductivity lower than the material of said inner side wall;

and a detachable closure ring adapted to close the upper end of said annular chamber.

2. A cooling receptacle according to claim 1, wherein said inner side wall is cylindrical and terminates at its lower extremity at said base.

3. A cooling receptacle according to claim 1, wherein said outer side wall and said closure member are formed of a synthetic polymeric material.

4. A cooling receptacle according to claim 3, wherein the granular material in said base is sand.

5. A cooling receptacle according to claim 1, wherein a handle is secured to the outer surface of said outer wall.

6. A cooling receptacle according to claim 1, wherein said outer side wall and the bottom and side walls of said base are integrally formed.

7. A cooling receptacle according to claim 6, wherein said inner side wall comprises a cylinder open at both ends and of lesser longitudinal dimension than said outer side wall, said cylinder being removably secured to the upper surface of said base.

* * * * *